United States Patent [19]

Kummer

[11] Patent Number: 4,840,101

[45] Date of Patent: Jun. 20, 1989

[54] ESCAPEMENT MECHANISM FOR UPRIGHT PIANO

[76] Inventor: Fernand Kummer, Route de Delemont 324, 2802 Develier, Switzerland

[21] Appl. No.: 248,719

[22] Filed: Sep. 26, 1988

[51] Int. Cl.[4] ..... G10C 3/18

[52] U.S. Cl. ..... 84/247

[58] Field of Search ..... 84/236, 240, 241, 247, 84/248, 249

[56] References Cited

U.S. PATENT DOCUMENTS 1,586,547 6/1926 Eastwood ..... 84/240
2,835,157 5/1958 Waters ..... 84/240

FOREIGN PATENT DOCUMENTS 23539 of 1906 United Kingdom ..... 84/236
169021 9/1921 United Kingdom ..... 84/240

*Primary Examiner*—L. T. Hix
*Assistant Examiner*—Brian W. Brown
*Attorney, Agent, or Firm*—Bacon & Thomas

[57] ABSTRACT

The prolongation of a jack in the escapement mechanism of an upright piano is provided with a repetition lever having a roller that is engageable with a vertically adjustable repetition button positioned beneath the roller so that priming of the mechanism begins from the moment the wippen enters its downstroke movement.

5 Claims, 4 Drawing Sheets

ESCAPEMENT MECHANISM FOR UPRIGHT PIANO

BACKGROUND OF THE INVENTION

1. Field of the Invention

The present invention generally involves the field of technology pertaining to pianos. More particularly, the invention relates to an improved escapement mechanism for an upright piano.

2. Description of the Prior Art

A conventional grand piano is provided with a double escapement action which permits a repeated strike of the key with a light touch after the hammer has hit the string and before the key is significantly raised towards its position of rest. This action cannot be realized with a conventional upright piano since such a piano is only provided with a simpler action having only a single escapement. This difference results in an annoying disadvantage when playing an upright piano, particularly when the playing trills, as in pianissimo. This disadvantage is not present in the action of a grand piano which permits repeated strikes, even when the key is depressed with only light touches of the key.

Various unsuccessful attempts have heretofore been made in providing an upright piano with the advantageous playing action realized with a grand piano.

SUMMARY OF THE INVENTION

It is an object of the invention to provide an improved escapement mechanism for an upright piano which permits such a piano to be played in the manner of a grand piano.

It is another object of the invention to provide an improved escapement mechanism for an upright piano which permits the piano to be played in a more expressive manner so that repetitive notes in pianissimo can be played legato without interruption in the sound produced.

It is a further object of the invention to provide an improved escapement mechanism which is simple in construction and may be readily incorporated with a conventional escapement mechanism in order to provide enhanced playing characteristics.

These and other objects of the invention are realized by providing the jack of the escapement mechanism in an upright piano with a repetition lever which extends outwardly from a lower prolongation of the jack. The outer end of the lever is provided with a felt roller which engages the top of a vertically adjustable repetition button positioned beneath the roller. The length of the repetition lever and the height of the repetition button are predetermined so that the escapement action begins to be primed from the moment then wippen of the mechanism enters its downstroke movement.

These and other objects, features and advantages of the invention shall become apparent from the following detailed description of a preferred embodiment thereof, when taken in conjunction with the drawings wherein like reference characters refer to corresponding parts in the several views.

DETAILED DESCRIPTION OF THE PREFERRED EMBODIMENT

Figure 1:
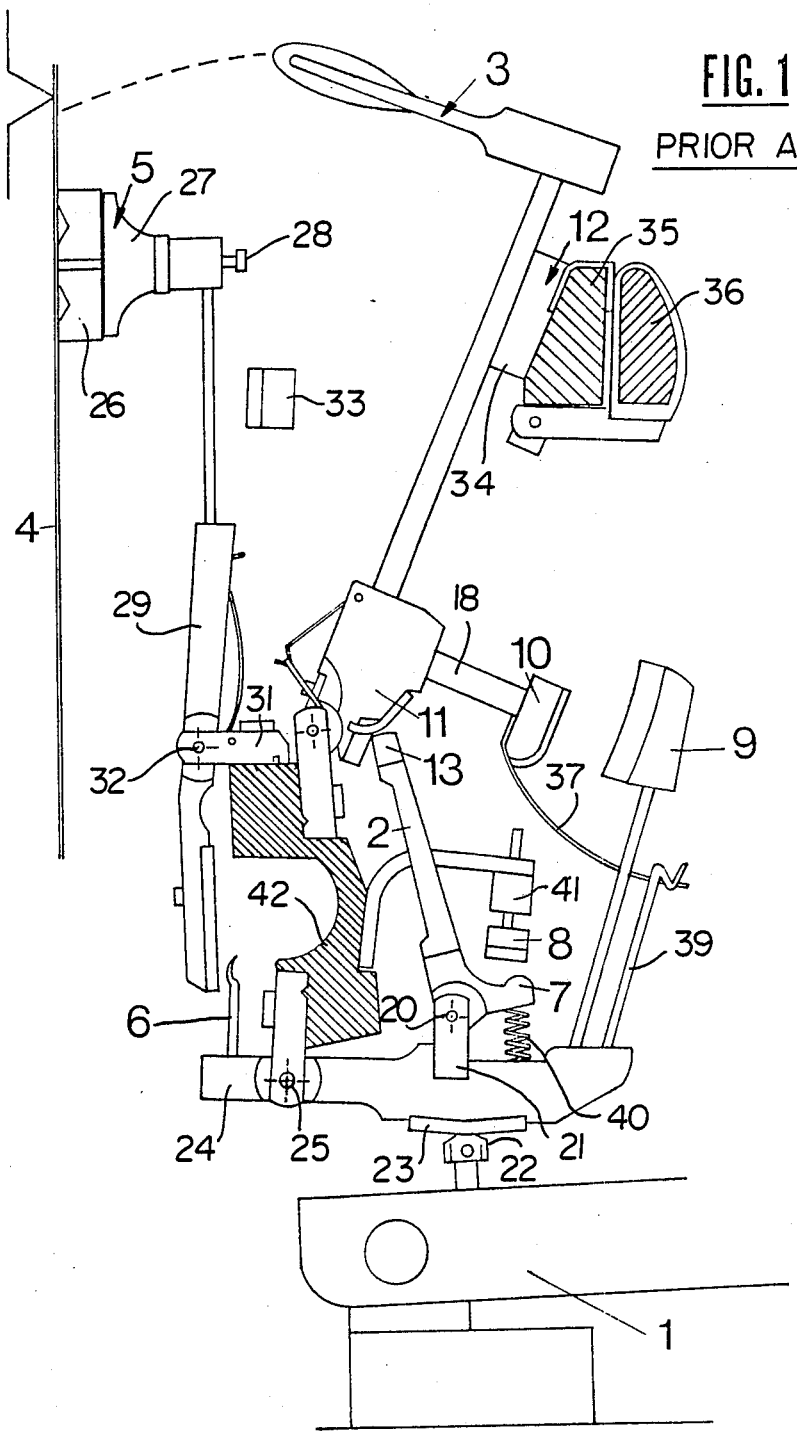
FIG. 1 PRIOR ART
FIG. 1 is a partial cross-sectional view of a conventional upright piano mechanism with the key shown in a released position of rest.

A conventional escapement action for an upright piano shall initially be described with reference to FIGS. 1 and 2. As shown therein, the downward movement of a piano key 1 causes a capstan screw 22 mounted on key 1 to raise upwardly and engage a cushion 23 of a wippen 24 mounted for pivotal movement about a center pin 25. This causes wippen 24 to be raised, thereby also imparting a corresponding raising of a jack 2, the latter in turn causing a simultaneous thrust of a hammer 3 in the direction of a piano string 4. As key 1 is depressed, string 4 is freed from a damper 5 by the action of a spoon 6, so that the momentum of hammer 3 causes same to hit string 4. An escapement is realized immediately prior to hammer 3 hitting string 4 because a prolongation 7 at the lower end of jack 2 engages a regulating button 8. This causes jack 2 to move back and a tip 13 at the upper end of jack 2 slides onto a butt 11 of hammer 3, thereby permitting hammer 3 to freely pursue its movement. Once escapement is triggered, key 1 also continues its downward movement independent of hammer 3. When hammer 3 strikes string 4 and is propelled rearwardly, key 1 remains fully depressed and a butt heel 10 mounted on an arm 18 of hammer 3 engages a back check 9 which remains in a raised position.

If key 1 rises faster than the rearward movement of hammer 3, jack 2 returns into place below butt 11 and the action is then ready for a second blow, with damper 5 having again returned in its position of engagement against string 4. At the end of this procedure, hammer 3 falls back into engagement on a rest 12. However, if hammer 3 falls rearwardly faster than key 1 rises, then jack 2 does not have sufficient time to return to its position under butt 11. The only way that the action can be ready for a second blow is for the fingers of the pianist to be lifted so that key 1 can rise upwardly a sufficient distance. This is precisely the disadvantage and major inconvenience of a conventional upright piano action. As previously noted herein, a light touch of key 1 is insufficient to place the action in condition for a second blow. Therefore, significant force is required with a mechanism of this type to play trills, particularly pianissimo.

Figure 2:
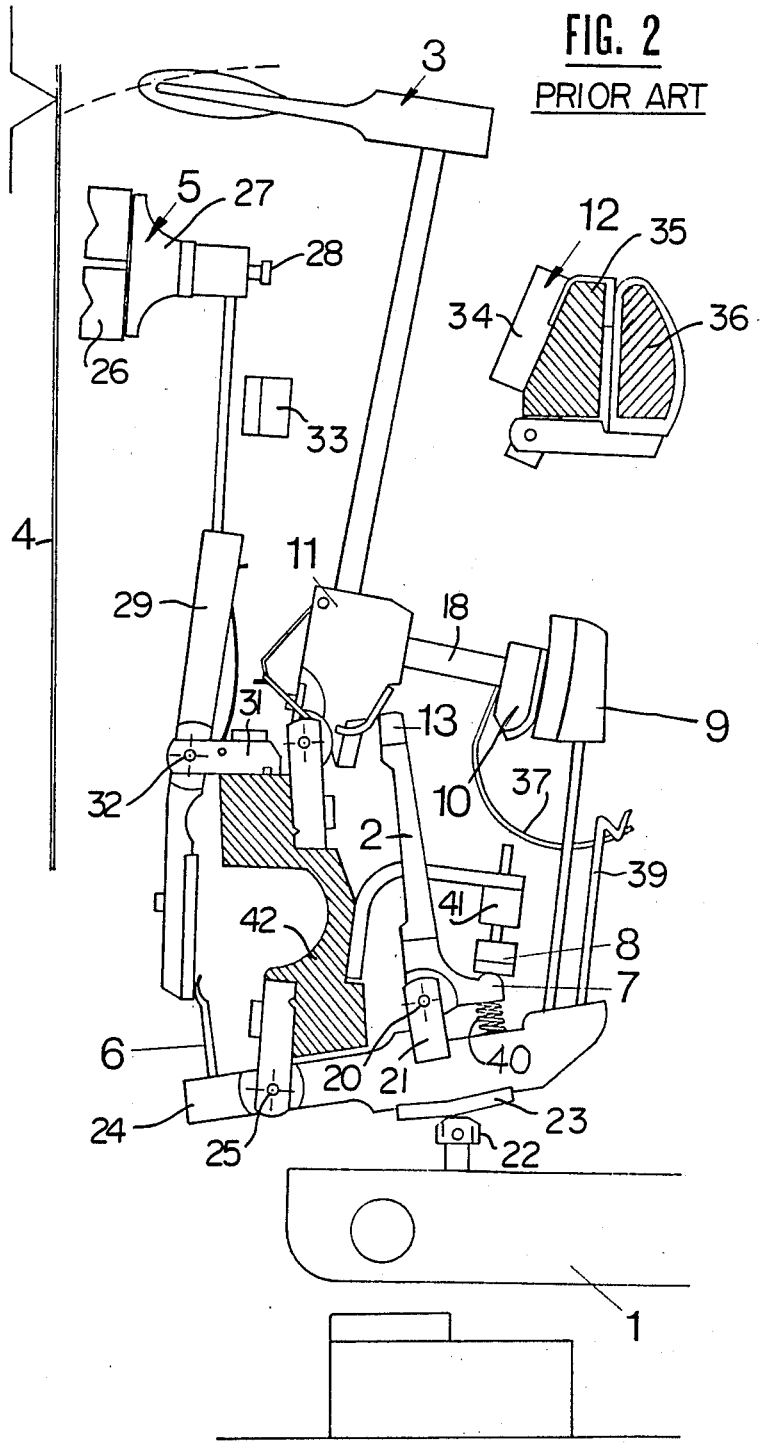
FIG. 2 PRIOR ART
FIG. 2 is a partial cross-sectional view of the mechanism shown in FIG. 1, but depicted with the key in a depressed position and the hammer falling backward after hitting the string.

As also shown in FIGS. 1 and 2, damper 5 includes a felt 26 for engaging string 4 and an associated drum block 27 and set screw 28. Damper 5 is mounted on a lever 29 which in turn is mounted to a lever flange 31 for pivotal movement about a center pin 32. A damper stop 33 is disposed behind damper 5 for limiting the rearward movement thereof. Hammer rest 12 includes a felt 34 for engagement by hammer 3 and an associated half blow rest rail 35 and a rest rail 36. Butt heel 10 is provided with an associated butt heel leather 37 and a bridle wire 39. Jack 2 is mounted to wippen 24 by a flange 21 for pivotal movement about a center pin 20. Pivotal movement of jack 2 is biased by a spring 40. Regulating button 8 is mounted to a regulating rail 41 and there is provided a main action rail 42.

Figure 3:
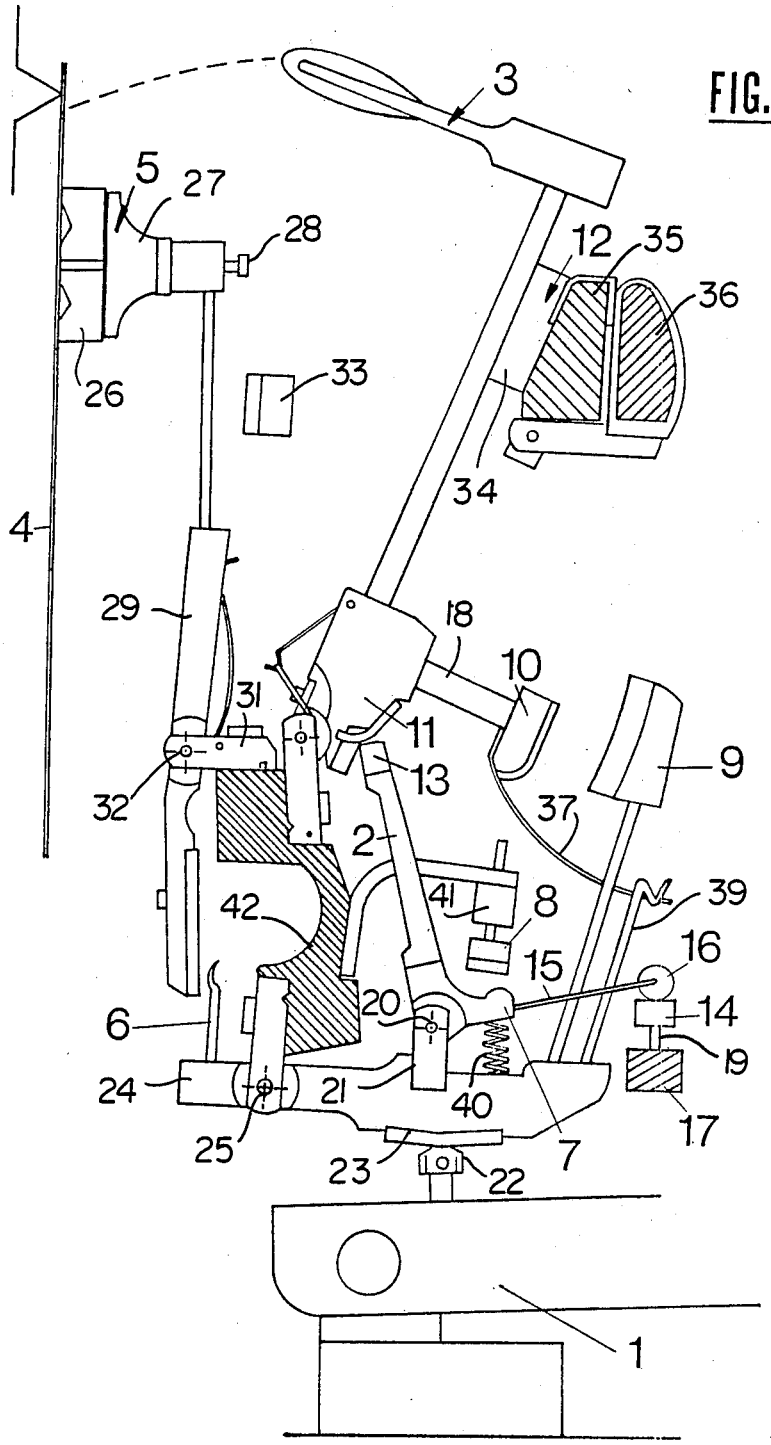
FIG. 3 is a partial cross-sectional view of an escapement mechanism for an upright piano incorporating a preferred embodiment of the invention and showing the key in a released position of rest.
Figure 4:
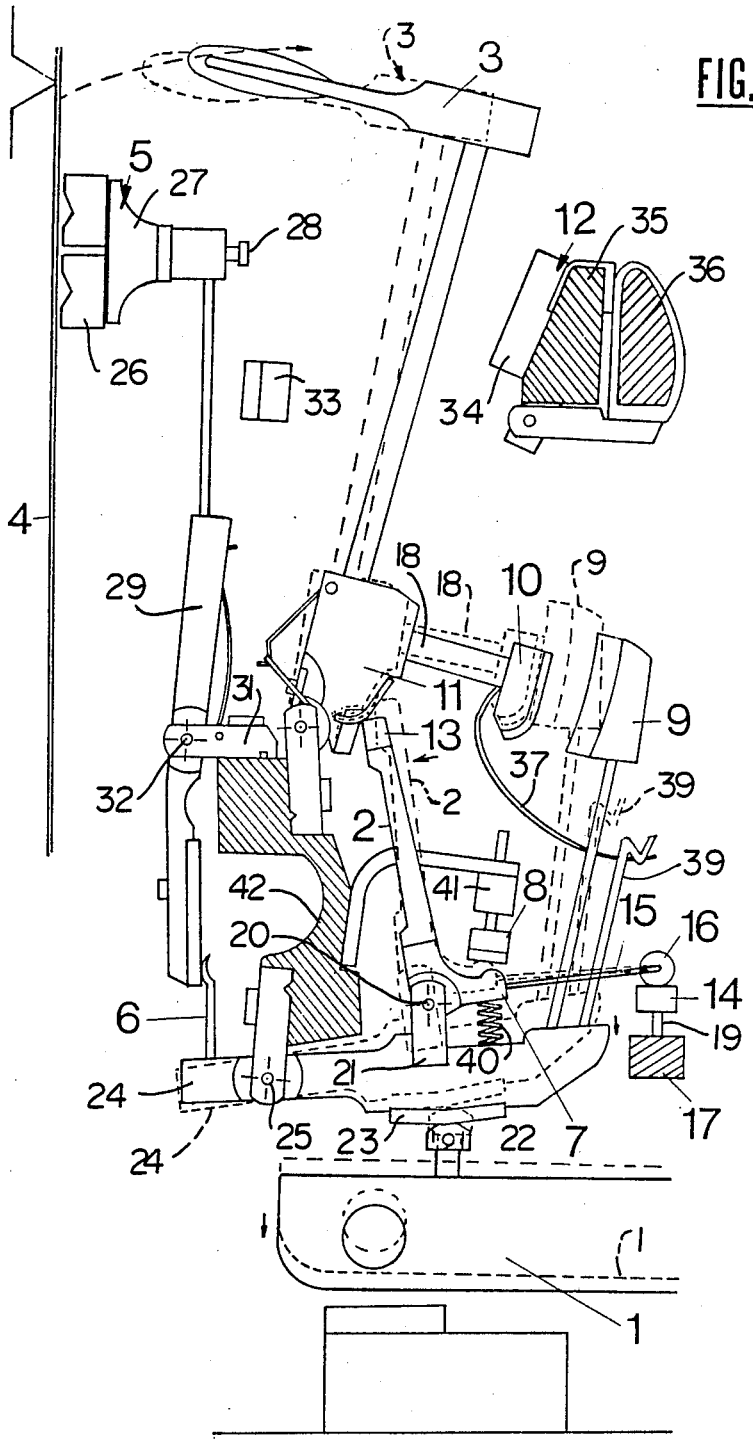
FIG. 4 is a partial cross-sectional view of the mechanism shown in FIG. 3 at the moment when the key is halfway released after having been depressed and with the hammer falling backward after having hit the string, with the phantom lines depicting the main portions of the mechanism when the key remains depressed and the hammer has initiated its backward movement.

An escapement action according to a preferred embodiment of the invention shall now be described with reference to FIGS. 3 and 4. As depicted therein, prolongation 7 of jack 2 is provided with an outwardly extending repetition level 15. A felt roller 16 is mounted on the outward end of lever 15 for engaging a repetition button 14 that in turn is mounted to a bar 17 by a threaded rod 19 which permits vertical adjustment of button 14. Bar 17 is preferably made of wood. Vertical adjustment of button 14 permits it to be disposed at such a height that engagement by a roller 16 can be realized at an exact desired moment. Lever 15 is preferably a steel rod and prolongation 7 of jack 2 is preferably formed of wood so that an end of lever 15 may be inserted therein.

As soon as key 1 is depressed, wippen 24 is urged upwardly, thereby also raising the assembly of jack 2 and prolongation 7. Repetition lever 15, being attached to prolongation 7, also rises simultaneously, thus causing roller 17 to separate from its engagement against repetition button 14. When jack 2 comes to the end of its course of movement, prolongation 7 strikes regulating button 8 and jack 2 tilts around center pin 20 of flange 21, causing tip 13 to slide under butt 11. This tilting movement also is imparted to repetition lever 15 and is brought to a stop when roller 16 engages repetition button 14. As soon as key 1 rises, wippen 15 goes back down and draws jack 2 downwardly therewith. When roller 16 is blocked at the height of button 14, this descending movement causes the L-shaped assembly formed by jack 2, prolongation 7 and lever 15 to tilt in the opposite direction. Jack tip 13 then slides under butt 11 and returns to its original position. The speed of this priming action is increased with the height of button 14. Thus, button 14 can be easily set at a height wherein the mechanism is against primed to thrust hammer 3 back against string 4 without any significant raising of key 1. A slight release of key 1, once it has been depressed, is sufficient to thrust hammer 3 a second time towards string 4 by hitting key 1 again. The mechanism would be optimally adjusted at the point where roller 16 strikes butt 14 at just the moment when back check 9 is engaged by heel 10.

It is therefore apparent that the invention provides an enhanced playing capability for an upright piano wherein both quick and slow repetitions may now be realized, notwithstanding the position of the key and force of the strike, in a manner which simply cannot be realized by conventional escapement mechanism. The invention permits the piano to be played in a more expressive manner and repetitive notes in pianissimo can now be played legato without any interruption in the sound.

It is to be understood that the form of the invention herein shown and described is to be taken as a preferred embodiment of the same and that various changes in shape, material, size and arrangement of parts may be resorted to without departing from the spirit of the invention or scope of the subjoined claims.

I claim:

1. An escapement mechanism for an upright piano of the type including a jack pivotally mounted on a movable wippen and provided with a tip at its upper end and a prolongation at its lower end, and a hammer including a butt, the improvement comprising at least one repetition lever carried by the prolongation to define an L-shaped assembly with the jack and prolongation, at least one repetition button disposed below the repetition lever for engagement thereby when the wippen moves outwardly during escapement, thereby causing tilting of the jack so that the tip thereof may be disposed in an original position below the butt.

2. The escapement mechanism of claim 1 wherein the repetition button is vertically adjustable.

3. The escapement mechanism of claim 1 wherein the repetition lever forms an extension of the prolongation.

4. The escapement mechanism of claim 3 wherein the repetition lever is a metal rod having one end inserted into the prolongation.

5. The escapement mechanism of claim 1 wherein the repetition lever includes a free end and a felt roller carried by the free end for engaging the repetition button.

* * * * *